US010009691B2

(12) United States Patent
Xu

(10) Patent No.: US 10,009,691 B2
(45) Date of Patent: Jun. 26, 2018

(54) SOUND CHANNEL CONFIGURATION METHOD AND APPARATUS AND EARPHONE DEVICE

(71) Applicant: Beijing Zhigu Rui Tuo Tech Co., Ltd, Beijing (CN)

(72) Inventor: Ran Xu, Beijing (CN)

(73) Assignee: BEIJING ZHIGU RUI TUO TECH CO., LTD, Beijing (CN)

( * ) Notice: Subject to any disclaimer, the term of this patent is extended or adjusted under 35 U.S.C. 154(b) by 0 days. days.

(21) Appl. No.: 15/129,822

(22) PCT Filed: Dec. 29, 2014

(86) PCT No.: PCT/CN2014/095265

§ 371 (c)(1),
(2) Date: Sep. 27, 2016

(87) PCT Pub. No.: WO2015/149556

PCT Pub. Date: Oct. 8, 2015

(65) Prior Publication Data

US 2017/0142521 A1 May 18, 2017

(30) Foreign Application Priority Data

Apr. 2, 2014 (CN) ..... 2014 1 0130906

(51) Int. Cl.
*H04R 1/10* (2006.01)
*H04R 5/04* (2006.01)
(Continued)

(52) U.S. Cl.
CPC ..... *H04R 5/04* (2013.01); *H04R 1/1091* (2013.01); *H04R 29/001* (2013.01); *H04R 5/033* (2013.01)

(58) Field of Classification Search
CPC ..... H04R 5/04; H04R 1/1091; H04R 29/001; H04R 5/033
See application file for complete search history.

(56) References Cited

U.S. PATENT DOCUMENTS 8,831,240 B2 9/2014 Zhong
2010/0172522 A1 7/2010 Mooring et al.
(Continued)

FOREIGN PATENT DOCUMENTS

CN 102316394 A 1/2012
CN 202759571 U 2/2013
(Continued)

OTHER PUBLICATIONS

International Search Report for PCT Application No. PCT/CN2014/095265, dated Apr. 8, 2015, 3 pages.

*Primary Examiner* — Regina N Holder
(74) *Attorney, Agent, or Firm* — Amin, Turocy & Watson, LLP

(57) ABSTRACT

Embodiments of the present application provide a sound channel configuration method and apparatus and an earphone device. The method includes: obtaining heartbeat transmission signals at one earpiece and a reference position of a human body; and performing sound channel configuration on a signal of the earpiece at least according to the heartbeat transmission signals at the earpiece and the reference position. The embodiments of the present application provide sound channel configuration solutions.

20 Claims, 3 Drawing Sheets

(51) Int. Cl.
*H04R 29/00* (2006.01)
*H04R 5/033* (2006.01)

(56) References Cited

U.S. PATENT DOCUMENTS

| | | | | |
|---|---|---|---|---|
| 2011/0249854 | A1 | 10/2011 | Nystrem | |
| 2012/0114154 | A1 | 5/2012 | Abrahamsson | |
| 2013/0279724 | A1* | 10/2013 | Stafford | H04R 1/1041 381/309 |
| 2014/0079238 | A1 | 3/2014 | Bastide et al. | |
| 2015/0342524 | A1* | 12/2015 | Sudo | G06F 21/35 340/870.07 |
| 2015/0342528 | A1* | 12/2015 | Sudo | A61B 5/6843 600/393 |

FOREIGN PATENT DOCUMENTS

| | | | |
|---|---|---|---|
| CN | 103929697 | A | 7/2014 |
| TW | 201220861 | A | 5/2012 |

* cited by examiner

SOUND CHANNEL CONFIGURATION METHOD AND APPARATUS AND EARPHONE DEVICE

RELATED APPLICATION

The present application is a U.S. National Stage filing under 35 U.S.C. § 371 of international patent cooperation treaty (PCT) application No. PCT/CN2014/095264, filed Dec. 29, 2014, and entitled "SOUND CHANNEL CONFIGURATION METHOD AND APPARATUS AND EARPHONE DEVICE", which claims the benefit of priority to Chinese Patent Application No. 201410130906.5, filed on Apr. 2, 2014, which applications are hereby incorporated into the present application by reference herein in their respective entireties.

TECHNICAL FIELD

The present application relates to the field of signal processing technologies, and in particular, to a sound channel configuration method and apparatus and an earphone device.

BACKGROUND

A conventional earphone device generally includes two earpieces in pair, where one is a left earpiece and the other is a right earpiece; and sound channels of signals of the left earpiece and the right earpiece are respectively a left sound channel and a right sound channel. In order to distinguish the left earpiece and the right earpiece, a letter L indicating left and a letter R indicating right are generally printed on the two earpieces separately or shapes of the two earpieces are separately designed to be suitable for a left ear or a right ear.

Even so, a user may still wear the left earpiece and the right earpiece oppositely, leading to poor experience of earpiece signals.

SUMMARY

In view of this, an example objective of embodiments of the present application is to provide sound channel configuration solutions.

In order to achieve the foregoing objective, according to an example aspect of the embodiments of the present application, a sound channel configuration method is provided, including:

- obtaining heartbeat transmission signals at one earpiece and a reference position of a human body; and
- performing sound channel configuration on a signal of the earpiece at least according to the heartbeat transmission signals at the earpiece and the reference position.

In order to achieve the foregoing objective, according to another example aspect of the embodiments of the present application, a sound channel configuration apparatus is provided, including:

- an obtaining module, configured to obtain heartbeat transmission signals at one earpiece and a reference position of a human body; and
- a configuration module, configured to perform sound channel configuration on a signal of the earpiece at least according to the heartbeat transmission signals at the earpiece and the reference position.

In order to achieve the foregoing objective, according to still another example aspect of the embodiments of the present application, an earphone device is provided, including: at least one earpiece and the sound channel configuration apparatus as described above.

At least one technical solution in the foregoing technical solutions has the following example beneficial effects.

One or more embodiments of the present application provide a sound channel configuration solution: obtaining heartbeat transmission signals at one earpiece and a reference position of a human body; and performing sound channel configuration on a signal of the earpiece at least according to the heartbeat transmission signals at the earpiece and the reference position.

DETAILED DESCRIPTION

Embodiments of the present application are further described in detail hereinafter with reference to the accompanying drawings and embodiments. The following embodiments are intended to describe the present application, but not to limit the scope of the present application.

Figure 1:
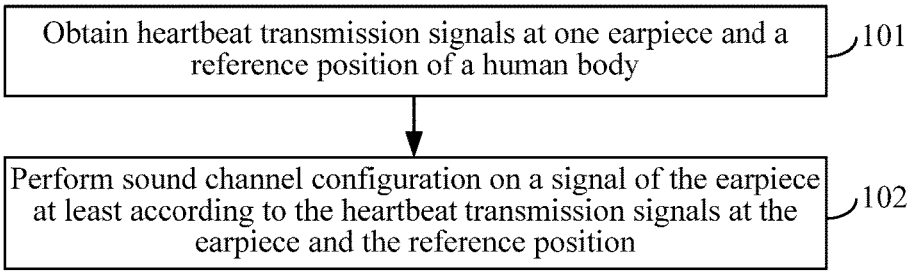
FIG. 1 is an example schematic flowchart of an embodiment of a sound channel configuration method according to the present application.

FIG. 1*a* is a schematic flowchart of an embodiment of a sound channel configuration method according to the present application. As shown in FIG. 1*a*, this embodiment includes:

101. Obtain heartbeat transmission signals at one earpiece and a reference position of a human body.

For example, a sound channel configuration apparatus provided by the present application carries out this embodiment, that is, the sound channel configuration apparatus obtains the heartbeat transmission signals at the earpiece and the reference position of the human body. Specifically, the sound channel configuration apparatus can be disposed in an earphone device or an audio output device in a software manner, a hardware manner, or a manner of a combination of software and hardware. According to an aspect, the earphone device may merely include a single earphone, or include two earphones in pair. According to another aspect, the earphone device may be a wireless earphone device, that is, the earphone device is capable of exchanging signals with an audio output device in a wireless manner; the earphone device may also be a wired earphone device, that is, the earphone device is capable of exchanging signals with an audio output device in a wired manner. The audio output device may be a device capable of outputting audio, such as a mobile phone, a tablet computer, or an MP3 player, and the audio output device is capable of exchanging signals with the earpiece in a wireless or wired manner.

Each one of the heartbeat transmission signal in this embodiment is a signal changing with a heartbeat. Specifically, the heartbeat transmission signal includes but is not limited to at least one of the following: an electrocardiographic waveform and a blood flow pulsation waveform. Specifically, each one of the heartbeat transmission signals can be acquired by using a corresponding biometric sensor. For example, the electrocardiographic waveform can be acquired by an electrocardiogram (ECG) sensor, and the blood flow pulsation waveform can be acquired by a photoplethysmography (or photoplethysmogram, PPG) sensor.

102. Perform sound channel configuration on a signal of the earpiece at least according to the heartbeat transmission signals at the earpiece and the reference position.

Specifically, the performing sound channel configuration on a signal of the earpiece includes: configuring a sound channel of the signal of the earpiece as a left sound channel or a right sound channel. There are many manners to configure the sound channel of the signal of one earpiece as a left sound channel or a right sound channel. For example, when the sound channel configuration apparatus is disposed in the earphone device, the choice of an input sound channel can be implemented on the basis of a default input sound channel configuration of a signal and a sound channel switching circuit, thereby implementing different sound channel configurations. For example, when the sound channel configuration apparatus is disposed in the audio output device, the choice of an output sound channel can be implemented on the basis of a default output sound channel configuration of a signal and a sound channel switching circuit, thereby implementing different sound channel configurations. Alternatively, different sound channel configurations can be implemented by changing content of a signal.

Because a heartbeat passes different paths to be transmitted from the heart to a left ear and to a right ear, a difference between a heartbeat transmission signal at an earpiece located at the left ear and a heartbeat transmission signal at the reference position correspondingly differs from a difference between a heartbeat transmission signal at the earpiece located at the right ear and the heartbeat transmission signal at the reference position. On the basis of the foregoing differences, it can be determined whether the earpiece is located at the left ear or the right ear, thereby performing corresponding sound channel configuration.

Generally, in order to perform sound channel configuration on the signal of the earpiece, not only the obtained heartbeat transmission signals at the earpiece and the reference position but also a rule of differences between heartbeat transmission signals at different positions that is learnt in advance or set by a user needs to be taken into consideration, wherein the heartbeat transmission signals at different positions include: a heartbeat transmission signal at the earpiece when the earpiece is located at a left ear, a heartbeat transmission signal of the earpiece when the earpiece is located at a right ear, and a heartbeat transmission signal at the determined reference position.

In an optional embodiment, the performing sound channel configuration on a signal of the earpiece at least according to the heartbeat transmission signals at the earpiece and the reference position includes:

comparing, in a same signal period, a crest of the heartbeat transmission signal at the earpiece with a crest of the heartbeat transmission signal at the reference position, and determining whether the earpiece is located at a left ear or a right ear of the human body; and configuring a sound channel of the signal of the earpiece as a left sound channel in response to determining that the earpiece is located at the left ear of the human body; or configuring a sound channel of the signal of the earpiece as a right sound channel in response to determining that the earpiece is located at the right ear of the human body.

Generally, the heart of a human body is located at a left side of the human body, so that a path in which a heartbeat is transmitted from the heart to the left ear is shorter than a path in which the heartbeat is transmitted to the right ear. Correspondingly, by comparing the heartbeat transmission signal of the earpiece located at the left ear with the heartbeat transmission signal of the earpiece located at the right ear, it can be known that in a same signal period a crest of the heartbeat transmission signal of the earpiece located at the left ear appears earlier than a crest of the heartbeat transmission signal of the earpiece located at the right ear.

Figure 2A:
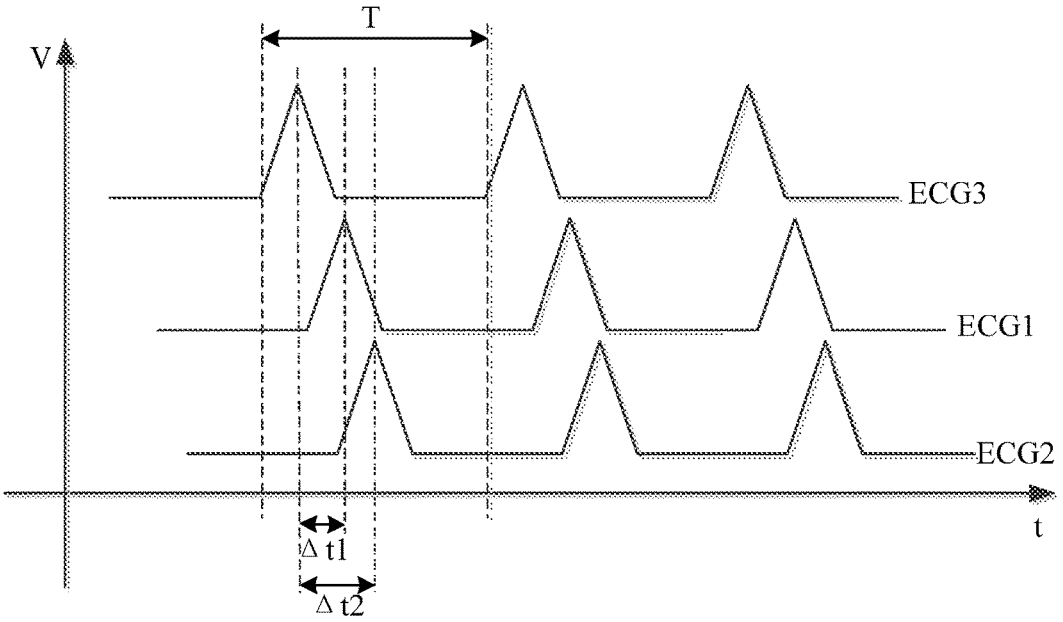
FIGS. 2*a* to 2*c* are example schematic diagrams of electrocardiographic waveforms at different positions in various scenarios.

In one possible scenario, a path (recorded as Dc) in which the heartbeat is transmitted from the heart to the reference position is shorter than a path (recorded as D1) in which the heartbeat is transmitted to the left ear, that is, $Dc<Dl$; the path D1 in which the heartbeat is transmitted from the heart to the left ear is shorter than a path (recorded as Dr) in which the heartbeat is transmitted to the right ear, that is, $Dl<Dr$. Accordingly $|Dc-Dl|<|Dc-Dr|$. When the earpiece is located at the left ear, by comparing the crest of the heartbeat transmission signal at the earpiece with the crest of the heartbeat transmission signal at the reference position in the same signal period, it can be known that the crest of the heartbeat transmission signal at the reference position appears earlier, and assume that a time interval between the two crests is $\Delta t1$; when the earpiece is located at the right ear, by comparing the crest of the heartbeat transmission signal at the earpiece and the crest of the heartbeat transmission signal at the reference position in the same signal period, it can be known that the crest of the heartbeat transmission signal at the reference position appears earlier, and assume that a time interval between the two crests is $\Delta t2$; because $|Dc-Dl|<|Dc-Dr|$, accordingly, $\Delta t1<\Delta t2$. FIG. 2*a* is a simplified schematic diagram of electrocardiographic waveforms at different positions in this scenario. As shown in FIG. 2*a*, ECG1 is an electrocardiographic waveform at the earpiece when the earpiece is located at the left ear, ECG2 is an electrocardiographic waveform at the earpiece when the earpiece is located at the right ear, and ECG3 is an electrocardiographic waveform at the reference position. In a same signal period T, the crest of ECG3 appears earlier than the crests of ECG1 and ECG2, the time interval between the crest of ECG3 and the crest of ECG1 is $\Delta t1$, and the time interval between the crest of ECG3 and the crest of ECG2 is $\Delta t2$, where $\Delta t1<\Delta t2$. On the basis of this, when the reference position is determined, a range of $\Delta t1$ and a range of $\Delta t2$ can be determined by means of learning or calculating, and the two ranges generally do not overlap. Therefore, when a solution of this embodiment is carried out, a time interval $\Delta t$ between two crests is obtained by comparison, and it is determined whether $\Delta t$ is in the range of $\Delta t1$ or in the range of $\Delta t2$. If $\Delta t$ is in the range of $\Delta t1$, it is determined that the earpiece is located at the left ear of the human body; and if $\Delta t$ is in the range of $\Delta t2$, it is determined that the earpiece is located at the right ear of the human body.

Figure 2B:
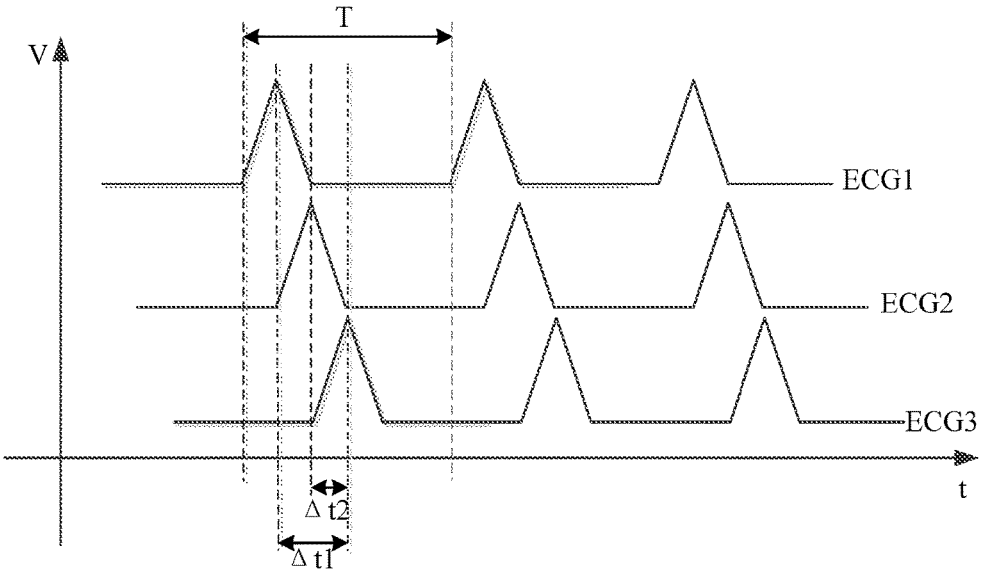

In another possible scenario, a path Dc in which the heartbeat is transmitted from the heart to the reference position is longer than a path Dr in which the heartbeat is transmitted to the right ear, that is, $Dc>Dr$; a path D1 in which the heartbeat is transmitted from the heart to the left ear is shorter than the path Dr in which the heartbeat is transmitted to the right ear, that is, $Dl<Dr$. Accordingly $|Dc-Dl|>|Dc-Dr|$. When the earpiece is located at the left ear, by comparing the crest of the heartbeat transmission signal at the earpiece and the crest of the heartbeat transmission signal at the reference position in the same signal period, it can be known that the crest of the heartbeat transmission signal at the earpiece appears earlier, and assume that a time interval between the two crests is Δt1; when the earpiece is located at the right ear, by comparing the crest of the heartbeat transmission signal at the earpiece and the crest of the heartbeat transmission signal at the reference position in the same signal period, it can be known that the crest of the heartbeat transmission signal at the earpiece appears earlier, and assume that a time interval between the two crests is Δt2; because |Dc−Dl|>|Dc−Dr|, accordingly, Δt1>Δt2. FIG. 2*b* is a simplified schematic diagram of electrocardiographic waveforms at different positions in this scenario. As shown in FIG. 2*b*, ECG1 is an electrocardiographic waveform at the earpiece when the earpiece is located at the left ear, ECG2 is an electrocardiographic waveform at the earpiece when the earpiece is located at the right ear, and ECG3 is an electrocardiographic waveform at the reference position. In a same signal period T, both crests of ECG1 and ECG2 appear earlier than the crest of ECG3, a time interval between the crest of ECG3 and the crest of ECG1 is Δt1, and a time interval between the crest of ECG3 and the crest of ECG2 is Δt2, where Δt1>Δt2. On the basis of this, when the reference position is determined, a range of Δt1 and a range of Δt2 can be determined by means of learning or calculating, and the two ranges generally do not overlap. Therefore, when a solution of this embodiment is carried out, a time interval Δt between two crests is obtained by comparison, and it is determined whether Δt is in the range of Δt1 or in the range of Δt2. If Δt is in the range of Δt1, it is determined that the earpiece is located at the left ear of the human body; and if Δt is in the range of Δt2, it is determined that the earpiece is located at the right ear of the human body.

Figure 2C:
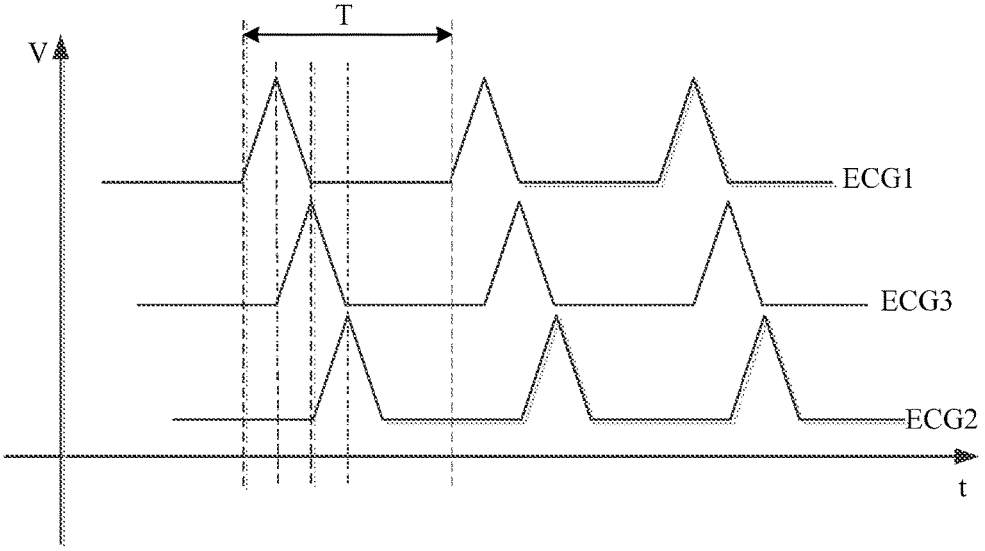

In still another possible scenario, a path Dc in which the heartbeat is transmitted from the heart to the reference position is shorter than a path Dr in which the heartbeat is transmitted to the right ear, and is longer than a path D1 in which the heartbeat is transmitted to the left ear, that is, Dl<Dc<Dr. When the earpiece is located at the left ear, by comparing the crest of the heartbeat transmission signal at the earpiece and the crest of the heartbeat transmission signal at the reference position in the same signal period, it can be known that the crest of the heartbeat transmission signal at the earpiece appears earlier; when the earpiece is located at the right ear, by comparing the crest of the heartbeat transmission signal at the earpiece and the crest of the heartbeat transmission signal at the reference position in the same signal period, it can be known that the crest of the heartbeat transmission signal at the reference position appears earlier. FIG. 2*c* is a simplified schematic diagram of electrocardiographic waveforms at different positions in this scenario. As shown in FIG. 2*c*, ECG1 is an electrocardiographic waveform at the earpiece when the earpiece is located at the left ear, ECG2 is an electrocardiographic waveform at the earpiece when the earpiece is located at the right ear, and ECG3 is an electrocardiographic waveform at the reference position. In a same signal period T, the crest of ECG1 appears earlier than the crest of ECG3, and the crest of ECG3 appears earlier than the crest of ECG 2. On the basis of this, after the reference position is determined, a sequence of the two crests in the same signal period is compared when a solution of this embodiment is carried out. If the crest of the heartbeat transmission signal at the earpiece appears earlier, it can be determined that the earpiece is located at the left ear of the human body; and if the crest of the heartbeat transmission signal at the reference position appears earlier, it can be determined that the earpiece is located at the right ear of the human body.

This embodiment provides a sound channel configuration solution by obtaining heartbeat transmission signals at one earpiece and a reference position of a human body, and performing sound channel configuration on a signal of the earpiece at least according to the heartbeat transmission signals at the earpiece and the reference position.

Figure 3A:
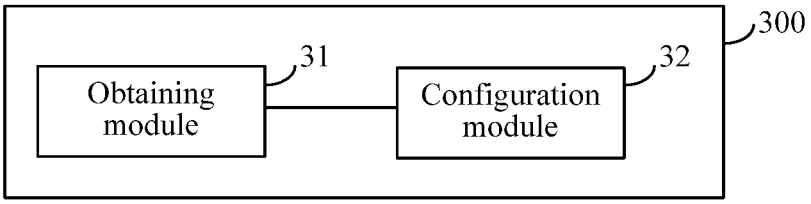
FIG. 3*a* is an example schematic structural diagram of an embodiment of a sound channel configuration apparatus according to the present application.

FIG. 3*a* is a schematic structural diagram of an embodiment of a sound channel configuration apparatus according to the present application. As shown in FIG. 3*a*, the sound channel configuration apparatus (referred to as the apparatus for short hereinafter) 300 includes:

an obtaining module 31, for obtaining heartbeat transmission signals at one earpiece and a reference position of a human body; and a configuration module 32, for performing sound channel configuration on a signal of the earpiece at least according to the heartbeat transmission signals at the earpiece and the reference position.

Each one of the heartbeat transmission signals in this embodiment is a signal changing with a heartbeat. Specifically, each one of the heartbeat transmission signals includes but is not limited to at least one of the following: an electrocardiographic waveform and a blood flow pulsation waveform.

Specifically, the performing sound channel configuration on a signal of the earpiece by the configuration module 32 includes: configuring, by the configuration module 32, a sound channel of the signal of the earpiece as a left sound channel or a right sound channel. There are many manners for the configuration module 32 to configure the sound channel of the signal of one earpiece as a left sound channel or a right sound channel. For example, when the apparatus 300 is disposed in an earphone device, the choice of an input sound channel can be implemented by the configuration module 32 on the basis of a default input sound channel configuration of a signal and a sound channel switching circuit, thereby different sound channel configurations implemented. For example, when the apparatus 300 is disposed in the audio output device, the choice of an output sound channel can be implemented by the configuration module 32 on the basis of a default output sound channel configuration of a signal and a sound channel switching circuit, thereby different sound channel configurations implemented. Alternatively, different sound channel configurations can be implemented by changing content of a signal.

Because a heartbeat passes different paths to be transmitted from the heart to a left ear and to a right ear, a difference between a heartbeat transmission signal at an earpiece located at the left ear and a heartbeat transmission signal at the reference position correspondingly differs from a difference between a heartbeat transmission signal at the earpiece located at the right ear and the heartbeat transmission signal at the reference position. On the basis of the foregoing differences, the configuration module 32 can determine whether the earpiece is located at the left ear or the right ear, thereby performing corresponding sound channel configuration.

Generally, in order to perform sound channel configuration on the signal of the earpiece, the configuration module 32 not only considers the obtained heartbeat transmission signals at the earpiece and the reference position, but also needs to consider a rule of differences between heartbeat transmission signals at different positions that is learnt in advance or set by a user, where the heartbeat transmission signals at different positions include: a heartbeat transmission signal at the earpiece when the earpiece is located at a left ear, a heartbeat transmission signal of the earpiece when the earpiece is located at a right ear, and a heartbeat transmission signal at the determined reference position.

Figure 3B:
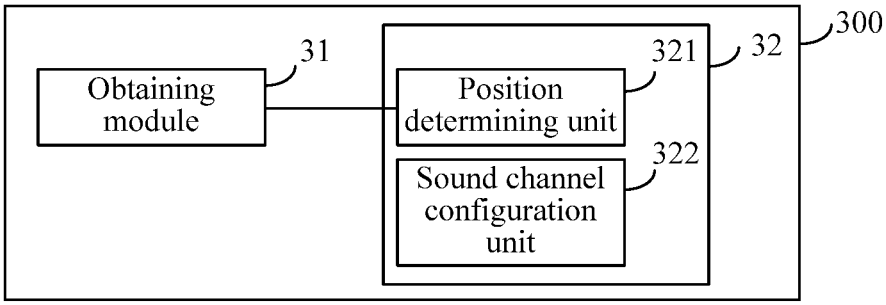
FIG. 3*b* is an example schematic structural diagram of the embodiment shown in FIG. 3*a;*

In an optional embodiment, as shown in FIG. 3*b*, the configuration module 32 includes:

a position determining unit 321, configured to compare, in a same signal period, a crest of the heartbeat transmission signal at the earpiece with a crest of the heartbeat transmission signal at the reference position, and determining whether the earpiece is located at a left ear or a right ear of the human body; and a sound channel configuration unit 322, configured to configure a sound channel of the signal of the earpiece as a left sound channel in response to determining that the earpiece is located at the left ear of the human body, or configure a sound channel of the signal of the earpiece as a right sound channel in response to determining that the earpiece is located at the right ear of the human body.

Generally, the heart of a human body is located at a left side of the human body, so that a path in which a heartbeat is transmitted from the heart to the left ear is shorter than a path in which the heartbeat is transmitted to the right ear. Correspondingly, by comparing the heartbeat transmission signal of the earpiece located at the left ear with the heartbeat transmission signal of the earpiece located at the right ear, it can be known that in a same signal period a crest of the heartbeat transmission signal of the earpiece located at the left ear appears earlier than a crest of the heartbeat transmission signal of the earpiece located at the right ear.

In one possible scenario, a path (recorded as Dc) in which the heartbeat is transmitted from the heart to the reference position is shorter than a path (recorded as D1) in which the heartbeat is transmitted to the left ear, that is, Dc<Dl; the path D1 in which the heartbeat is transmitted from the heart to the left ear is shorter than a path (recorded as Dr) in which the heartbeat is transmitted to the right ear, that is, Dl<Dr. Accordingly |Dc−Dl|<|Dc−Dr|. When the earpiece is located at the left ear, by comparing the crest of the heartbeat transmission signal at the earpiece with the crest of the heartbeat transmission signal at the reference position in the same signal period, it can be known that the crest of the heartbeat transmission signal at the reference position appears earlier, and assume that a time interval between the two crests is Δt1; when the earpiece is located at the right ear, by comparing the crest of the heartbeat transmission signal at the earpiece and the crest of the heartbeat transmission signal at the reference position in the same signal period, it can be known that the crest of the heartbeat transmission signal at the reference position appears earlier, and assume that a time interval between the two crests is Δt2; because |Dc−Dl|<|Dc−Dr|, accordingly, Δt1<Δt2. As shown in FIG. 2*a*, ECG1 is an electrocardiographic waveform at the earpiece when the earpiece is located at the left ear, ECG2 is an electrocardiographic waveform at the earpiece when the earpiece is located at the right ear, and ECG3 is an electrocardiographic waveform at the reference position. In a same signal period T, the crest of ECG3 appears earlier than the crests of ECG1 and ECG2, the time interval between the crest of ECG3 and the crest of ECG1 is Δt1, and the time interval between the crest of ECG3 and the crest of ECG2 is Δt2, where Δt1<Δt2. On the basis of this, when the reference position is determined, a range of Δt1 and a range of Δt2 can be determined by means of learning or calculating, and the two ranges generally do not overlap. Therefore, when a solution of this embodiment is carried out, the position determining unit 321 obtains a time interval Δt between two crests by comparison, and determines whether Δt is in the range of Δt1 or in the range of Δt2. If Δt is in the range of Δt1, it is determined that the earpiece is located at the left ear of the human body; and if Δt is in the range of Δt2, it is determined that the earpiece is located at the right ear of the human body.

In another possible scenario, a path Dc in which the heartbeat is transmitted from the heart to the reference position is longer than a path Dr in which the heartbeat is transmitted to the right ear, that is, Dc>Dr; a path D1 in which the heartbeat is transmitted from the heart to the left ear is shorter than the path Dr in which the heartbeat is transmitted to the right ear, that is, Dl<Dr. Accordingly |Dc−Dl|>|Dc−Dr|. When the earpiece is located at the left ear, by comparing the crest of the heartbeat transmission signal at the earpiece and the crest of the heartbeat transmission signal at the reference position in the same signal period, it can be known that the crest of the heartbeat transmission signal at the earpiece appears earlier, and assume that a time interval between the two crests is Δt1; when the earpiece is located at the right ear, by comparing the crest of the heartbeat transmission signal at the earpiece and the crest of the heartbeat transmission signal at the reference position in the same signal period, it can be known that the crest of the heartbeat transmission signal at the earpiece appears earlier, and assume that a time interval between the two crests is Δt2; because |Dc−Dl|>|Dc−Dr|, accordingly, Δt1>Δt2. As shown in FIG. 2*b*, ECG1 is an electrocardiographic waveform at the earpiece when the earpiece is located at the left ear, ECG2 is an electrocardiographic waveform at the earpiece when the earpiece is located at the right ear, and ECG3 is an electrocardiographic waveform at the reference position. In a same signal period T, both crests of ECG1 and ECG2 appear earlier than the crest of ECG3, a time interval between the crest of ECG3 and the crest of ECG1 is Δt1, and a time interval between the crest of ECG3 and the crest of ECG2 is Δt2, where Δt1>Δt2. On the basis of this, when the reference position is determined, a range of Δt1 and a range of Δt2 can be determined by means of learning or calculating, and the two ranges generally do not overlap. Therefore, when a solution of this embodiment is carried out, the position determining unit 321 obtains a time interval Δt between two crests by comparison, and determines whether Δt is in the range of Δt1 or in the range of Δt2. If Δt is in the range of Δt1, it is determined that the earpiece is located at the left ear of the human body; and if Δt is in the range of Δt2, it is determined that the earpiece is located at the right ear of the human body.

In still another possible scenario, a path Dc in which the heartbeat is transmitted from the heart to the reference position is shorter than a path Dr in which the heartbeat is transmitted to the right ear, and is longer than a path D1 in which the heartbeat is transmitted to the left ear, that is, Dl<Dc<Dr. When the earpiece is located at the left ear, by comparing the crest of the heartbeat transmission signal at the earpiece and the crest of the heartbeat transmission signal at the reference position in the same signal period, it can be known that the crest of the heartbeat transmission signal at the earpiece appears earlier; when the earpiece is located at the right ear, by comparing the crest of the heartbeat transmission signal at the earpiece and the crest of the heartbeat transmission signal at the reference position in the same signal period, it can be known that the crest of the heartbeat transmission signal at the reference position appears earlier. As shown in FIG. 2*c*, ECG1 is an electrocardiographic waveform at the earpiece when the earpiece is located at the left ear, ECG2 is an electrocardiographic waveform at the earpiece when the earpiece is located at the right ear, and ECG3 is an electrocardiographic waveform at the reference position. In a same signal period T, the crest of ECG1 appears earlier than the crest of ECG3, and the crest of ECG3 appears earlier than the crest of ECG 2. On the basis of this, after the reference position is determined, the position determining unit 321 compares a sequence of the two crests in the same signal period when a solution of this embodiment is carried out. If the crest of the heartbeat transmission signal at the earpiece appears earlier, it can be determined that the earpiece is located at the left ear of the human body; and if the crest of the heartbeat transmission signal at the reference position appears earlier, it can be determined that the earpiece is located at the right ear of the human body.

Specifically, the heartbeat transmission signals at the earpiece and the reference position can be acquired separately by biometric sensors at corresponding positions; and accordingly, the obtaining module 31 obtains the heartbeat transmission signals at the earpiece and the reference position from at least one biometric sensor at the earpiece and at least one biometric sensor at the reference position.

In an optional embodiment, each one of the heartbeat transmission signals includes: an electrocardiographic waveform. Optionally, the obtaining module 31 is further configured to: obtain electrocardiographic waveforms at the earpiece and the reference position from ECG sensors separately disposed at the earpiece and the reference position, where the earpiece and the reference position can be separately provided with at least one ECG sensor. For example, when one earpiece is provided with only one ECG sensor, the obtaining module 31 regards an electrocardiographic waveform obtained from the ECG sensor as the electrocardiographic waveform at the earpiece; when one earpiece is provided with multiple ECG sensors, the obtaining module 31 can perform a mean treatment on electrocardiographic waveforms obtained from the multiple ECG sensors, that is, the obtaining module 31 calculates the mean of values of points corresponding to the same time in the multiple electrocardiographic waveforms, and regards an electrocardiographic waveform obtained by the treatment as the electrocardiographic waveform at the earpiece.

In another optional embodiment, the heartbeat transmission signal includes: the blood flow pulsation waveform. Optionally, the obtaining module 31 is further configured to: obtain blood flow pulsation waveforms at the earpiece and the reference position from at least PPG sensors separately disposed at the earpiece and the reference position, where the earpiece and the reference position can be separately provided with at least one PPG sensor. For example, when one earpiece is provided with only one PPG sensor, the obtaining module 31 regards a blood flow pulsation waveform obtained from the PPG sensor as the blood flow pulsation waveform at the earpiece; when one earpiece is provided with multiple PPG sensors, the obtaining module 31 can perform a mean treatment on blood flow pulsation waveforms obtained from the multiple PPG sensors, that is, the obtaining module 31 calculates the mean of values of points corresponding to the same time in the multiple blood flow pulsation waveforms, and regards a blood flow pulsation waveform obtained by the treatment as the blood flow pulsation waveform at the earpiece.

Specifically, the apparatus 300 can be implemented in a software manner, a hardware manner, or a manner of a combination of software and hardware, and may be disposed in various devices.

In one possible scenario, the apparatus 300 and the earpiece are disposed together in one earphone device. According to an aspect, the earphone device may merely include a single earpiece, that is, the earpiece, or include two earpieces in pair, that is, in addition to the earpiece, another earpiece paired with the earpiece is also included. According to another aspect, the earphone device may be a wireless earphone device, that is, the earphone device is capable of exchanging signals with an audio output device in a wireless manner; the earphone device may also be a wired earphone device, that is, the earphone device is capable of exchanging signals with an audio output device in a wired manner.

In another possible scenario, the apparatus 300 is disposed in an audio output device providing the signal for the earpiece, where the audio output device may be a device capable of outputting audio, such as a mobile phone, a tablet computer, or an MP3 player, and the audio output device is capable of exchanging signals with the earpiece in a wireless or wired manner.

This embodiment provides a sound channel configuration solution by obtaining heartbeat transmission signals at one earpiece and a reference position of a human body, and performing sound channel configuration on a signal of the earpiece at least according to the heartbeat transmission signals at the earpiece and the reference position.

Figure 4A:
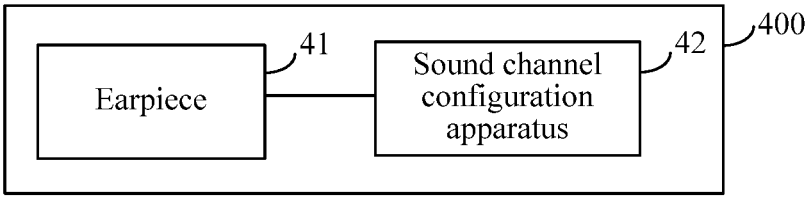
FIG. 4*a* is an example schematic structural diagram of an embodiment of an earphone device according to the present application.
Figure 4B:
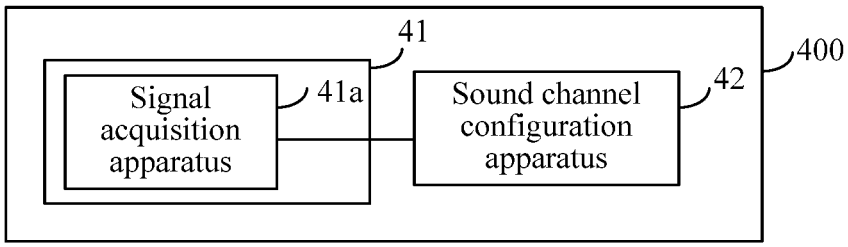
FIG. 4*b* is an example schematic structural diagram of the embodiment shown in FIG. 4*a*.

FIG. 4*a* is a schematic structural diagram of an embodiment of an earphone device according to the present application. As shown in FIG. 4*a*, the earphone device (referred to as the device for short hereinafter) 400 includes: at least one earpiece 41 and a sound channel configuration apparatus 42, wherein the sound channel configuration apparatus 42 is the apparatus 300 as described in the embodiment of a sound channel configuration apparatus according to the present application.

In one possible embodiment, the earpiece 400 includes only one earpiece 41.

In another possible embodiment, the device 400 includes two earpieces in pair, namely, the earpiece 41 and another earpiece paired with the earpiece 41 (not shown in FIG. 4*a*). Accordingly, the sound channel configuration apparatus 42 separately performs sound channel configuration on the earpiece 41 and the other earpiece paired with the earpiece 41.

In an optional embodiment, as shown in 4*b*, the device 400 further includes: at least one signal acquisition apparatus 41*a* disposed in the at least one earpiece 41, where at least one signal acquisition apparatus 41*a* is configured to acquire at least one heartbeat transmission signal. The at least one signal acquisition apparatus 41*a* is configured to acquire a heartbeat transmission signal at each of the at least one earpiece 41.

It should be noted that each one of the at least one signal acquisition apparatus 41*a* may also be disposed outside the at least one earpiece 41, for example, disposed near the at least one earpiece 41, which is not limited by this embodiment.

Optionally, the at least one signal acquisition apparatus 41*a* includes at least one of the following: at least one ECG sensor and at least one PPG sensor, wherein each one of the at least one ECG sensor can be configured to acquire an electrocardiographic waveform, and each one of the at least one PPG sensor can be configured to acquire a blood flow pulsation waveform.

Optionally, the reference position is also provided with at least one signal acquisition apparatus for acquiring a heartbeat transmission signal at the reference position. Generally, the at least one signal acquisition apparatus can be disposed in a wearable device which is worn at the reference position of a human body, wherein the wearable device may include but is not limited to any one of the following: an intelligent bracelet, an intelligent ring, and an intelligent insole and the like. For example, when the wearable device is the intelligent bracelet, the reference position is a wrist of the human body; when the wearable device is the intelligent ring, the reference position is a finger of the human body; and when the wearable device is the intelligent insole, the reference position is a sole of a foot of the human body.

Because the sound channel configuration apparatus 42 needs to compare the heartbeat transmission signal at the earpiece with the heartbeat transmission signal at the reference position, the heartbeat transmission signals used for comparison should be of the same type, and correspondingly, the at least one signal acquisition apparatus 41*a* at the earpiece 41 and the at least one signal acquisition apparatus at the reference position should include the same type signal acquisition apparatuses. For example, the at least one signal acquisition apparatus 41*a* at the earpiece 41 includes at least one ECG sensor, and the at least one signal acquisition apparatus at the reference position also includes at least one ECG sensor.

It should be noted that the device 400 may be a wireless earphone device, that is, the device is capable of exchanging signals with an audio output device in a wireless manner, and may also be a wired earphone device, that is, the device is capable of exchanging signals with an audio output device in a wired manner.

This embodiment of the present application provides a sound channel configuration solution by obtaining heartbeat transmission signals at one earpiece and a reference position of a human body, and performing sound channel configuration on a signal of the earpiece at least according to the heartbeat transmission signals at the earpiece and the reference position.

It can be realized by a person of ordinary skill in the art that, units and method steps described with reference to the embodiments disclosed in this specification can be implemented by electronic hardware or a combination of computer software and electronic hardware. Whether these functions are actually executed in a hardware or software form depends on specific applications and design constraints of the technical solution. A person skilled in the art may use different methods to implement the described function for each specific application, but such implementation should not be considered beyond the scope of the present application.

If the function is implemented in a form of a software functional unit and is sold or used as an independent product, the product can be stored in a computer-readable storage medium. Based on this understanding, the technical solution of the present application essentially, or a part, of the technical solution, that contributes to the prior art, or a part of the technical solution may be embodied in a form of a software product; the computer software product is stored in a storage medium and includes a number of instructions that enable a computer device (which may be a personal computer, a server, a network device, or the like) to execute all or some of the steps of the method in the embodiments of the present application. The foregoing storage medium includes all kinds of mediums that can store program code, such as a USB flash drive, a mobile hard disk, a read-only memory (ROM), a random access memory (RAM), a magnetic disk, or a compact disc.

The foregoing embodiments are only used to describe the present application, but not to limit the present application. A person of ordinary skill in the art can still make various alterations and modifications without departing from the spirit and scope of the present application; therefore, all equivalent technical solutions also fall within the scope of the present application, and the patent protection scope of the present application should be subject to the claims.

What is claimed is:

1. A method, comprising:

obtaining, by a device comprising a processor, heartbeat transmission signals at an earpiece and at a reference position of a human body, wherein the reference position is a position other than two ears of the human body; and performing sound channel configuration on a signal of the earpiece at least according to the heartbeat transmission signals at the earpiece and the reference position.

2. The method of claim 1, wherein the heartbeat transmission signals comprise at least one of an electrocardiographic waveform or a blood flow pulsation waveform.

3. The method of claim 1, wherein the performing the sound channel configuration on the signal comprises:

comparing, in a same signal period, a crest of a first heartbeat transmission signal at the earpiece with a crest of the first heartbeat transmission signal at the reference position;

determining whether the earpiece is located at a left ear or a right ear of the two ears of the human body; and configuring a first sound channel of the signal of the earpiece:

as a left sound channel in response to determining that the earpiece is located at the left ear of the human body; or as a right sound channel in response to determining that the earpiece is located at the right ear of the human body.

4. An apparatus, comprising:

a processor, coupled to a memory, that executes or facilitates execution of executable modules, comprising:

an obtaining module configured to obtain heartbeat transmission signals at an earpiece and a reference position of a human body, wherein the reference position is a position other than respective positions of two ears of the human body; and a configuration module configured to perform sound channel configuration on a signal of the earpiece at least according to the heartbeat transmission signals at the earpiece and the reference position.

5. The apparatus of claim 4, wherein the configuration module comprises:

a position determining unit configured to compare, in a same signal period, a crest of a heartbeat transmission signal at the earpiece with a crest of the heartbeat transmission signal at the reference position, and determining whether the earpiece is located at a left ear or a right ear of the human body; and a sound channel configuration unit configured to configure a sound channel of the signal of the earpiece as a left sound channel in response to determining that the earpiece is located at the left ear of the human body, or configure the sound channel of the signal of the earpiece as a right sound channel in response to determining that the earpiece is located at the right ear of the human body.

6. The apparatus of claim 4, wherein each one of the heartbeat transmission signals comprises: an electrocardiographic waveform.

7. The apparatus of claim 6, wherein the obtaining module is further configured to: obtain electrocardiographic waveforms at the earpiece and at the reference position from electrocardiogram (ECG) sensors separately disposed at the earpiece and at the reference position, and wherein the earpiece and the reference position are separately provided with at least one ECG sensor.

8. The apparatus of claim 4, wherein each one of the heartbeat transmission signals comprises: a blood flow pulsation waveform.

9. The apparatus of claim 8, wherein the obtaining module is further configured to: obtain blood flow pulsation waveforms at the earpiece and at the reference position from photoplethysmogram (PPG) sensors separately disposed at the earpiece and at the reference position, and wherein the earpiece and the reference position are separately provided with at least one PPG sensor.

10. The apparatus of claim 4, wherein the apparatus and the earpiece are disposed together in an earphone device.

11. The apparatus of claim 4, wherein the apparatus is disposed in an audio output device providing the signal for the earpiece.

12. The apparatus of claim 4, further comprising the earpiece and embodied in an earphone device.

13. The device of claim 12, further comprising: at least one signal acquisition apparatus separately disposed in the earpiece, wherein the at least one signal acquisition apparatus is separately configured to acquire a heartbeat transmission signal.

14. The device of claim 13, wherein the at least one signal acquisition apparatus comprises at least one of:

at least one electrocardiogram (ECG) sensor or at least one photoplethysmogram (PPG) sensor.

15. A non-transitory computer readable medium comprising executable instructions that, in response to execution, cause a device comprising a processor to perform operations, comprising:

obtaining heartbeat transmission signals at an earpiece and at a reference position of a human body, wherein the reference position is other than a position of either ear of the human body; and configuring a sound channel for a signal of the earpiece at least according to the heartbeat transmission signals at the earpiece and the reference position.

16. The non-transitory computer readable medium of claim 15, wherein the operations further comprise:

comparing, in a same signal period, a crest of a heartbeat transmission signal at the earpiece with a crest of the heartbeat transmission signal at the reference position, and determining whether the earpiece is located at a left ear or a right ear of the human body.

17. The non-transitory computer readable medium of claim 16, wherein the operations further comprise:

configuring the sound channel of the signal of the earpiece as a left sound channel in response to determining that the earpiece is located at the left ear of the human body.

18. The non-transitory computer readable medium of claim 16, wherein the operations further comprise:

configuring the sound channel of the signal of the earpiece as a right sound channel in response to determining that the earpiece is located at the right ear of the human body.

19. The non-transitory computer readable medium of claim 15, wherein the operations further comprise:

obtaining electrocardiographic waveforms at the earpiece and at the reference position from electrocardiogram (ECG) sensors separately disposed at the earpiece and at the reference position, wherein the earpiece and the reference position are separately provided with at least one ECG sensor.

20. The non-transitory computer readable medium of claim 15, wherein the operations further comprise:

obtaining blood flow pulsation waveforms at the earpiece and at the reference position from photoplethysmogram (PPG) sensors separately disposed at the earpiece and the reference position, wherein the earpiece and the reference position are separately provided with at least one PPG sensor.

* * * * *